US008177562B2

(12) United States Patent
Friedrich

(10) Patent No.: US 8,177,562 B2
(45) Date of Patent: May 15, 2012

(54) SOCKET ARRANGEMENT

(75) Inventor: Jürgen Friedrich, Halver (DE)

(73) Assignee: Escha Bauelemente GmbH, Halver (DE)

( * ) Notice: Subject to any disclaimer, the term of this patent is extended or adjusted under 35 U.S.C. 154(b) by 0 days.

(21) Appl. No.: 13/059,403

(22) PCT Filed: Aug. 12, 2009

(86) PCT No.: PCT/EP2009/060442

§ 371 (c)(1),
(2), (4) Date: Feb. 16, 2011

(87) PCT Pub. No.: WO2010/020571

PCT Pub. Date: Feb. 25, 2010

(65) Prior Publication Data

US 2011/0143572 A1 Jun. 16, 2011

(30) Foreign Application Priority Data

Aug. 21, 2008 (DE) ..... 10 2008 038 589

(51) Int. Cl.
*H01R 13/648* (2006.01)

(52) U.S. Cl. ..... 439/92; 439/97; 439/607.28

(58) Field of Classification Search ..... 439/92, 439/95–97, 607.28, 607.01, 76.1
See application file for complete search history.

(56) References Cited

U.S. PATENT DOCUMENTS

| | | | | |
|---|---|---|---|---|
| 5,192,216 | A | 3/1993 | Knauber et al. | |
| 5,227,955 | A * | 7/1993 | Le Bris et al. | 361/743 |
| 6,174,182 | B1 | 1/2001 | Kuo | |
| 6,422,899 | B1 | 7/2002 | Miyazaki | |
| 6,796,838 | B2 | 9/2004 | Yoshioka | |
| 7,029,329 | B1 * | 4/2006 | Huang | 439/607.01 |

FOREIGN PATENT DOCUMENTS

| | | |
|---|---|---|
| DE | 9112636 | 12/1991 |
| DE | 19942921 | 4/2001 |
| DE | 102006015718 A | 10/2007 |

* cited by examiner

*Primary Examiner* — Gary F. Paumen
(74) *Attorney, Agent, or Firm* — Lucas & Mercanti, LLP; Klaus P. Stoffel

(57) ABSTRACT

A socket arrangement having a housing, in particular a built-in housing, bearing at least one socket, preferably a plurality of sockets, the socket having an electrically conductive flange inserted into a housing opening, and a contact carrier which is inserted into the flange and which has one or more electrically conductive contacts for connecting to countercontacts of a plug corresponding to the socket. In order to effectively divert high-voltage discharges from the flange, a conductive element situated in the housing and having an introduction portion which is connected in an electrically conductive manner to a portion of the flange inside the housing, has a diversion portion which is connected to a diverter.

15 Claims, 9 Drawing Sheets

SOCKET ARRANGEMENT

The present application is a 371 of International application PCT/EP2009/060442 filed Aug. 12, 2009, which claims priority of DE 10 2008 038 589.1, filed Aug. 21, 2008, the priority of these applications is hereby claimed and these applications are incorporated herein by reference.

BACKGROUND OF THE INVENTION

The invention relates to a socket arrangement having a housing, in particular a built-in housing, bearing at least one, preferably a plurality of, sockets, the socket having an electrically conductive flange inserted into a housing opening, and a contact carrier inserted into the flange and having one or more electrically conductive contacts for connecting to countercontacts of a plug corresponding to the socket.

Such an arrangement is known from DE 10 2006 015 718 A1. The socket arrangement forms a distributor system, having a housing which bears a multiplicity of sockets into which corresponding plugs may be inserted. The plug is mechanically locked on an electrically conductive flange that has the form of a sleeve enclosing a contact carrier which forms the electrically conductive contacts. The flange may be connected to a shield of a cable which bears the plug.

SUMMARY OF THE INVENTION

It is an object of the invention to provide measures by means of which high-voltage discharges may be effectively diverted from the flange.

It is first and primarily provided that a conductive element is situated in the housing. The conductive element has an introduction portion which is connected to a portion of the flange on the inner side of the housing. The conductive element also has a diversion portion which is connected to a diverter, likewise situated in the housing. The contact carrier may be inserted into the flange from inside the housing, and may be clipped at that location. The clip connection of the contact carrier within the flange is of independent importance. In addition, the contact carrier may have a retaining portion which at least partially overlaps the end face of the flange when the introduction portion of the conductive element lying against the end-face portion of the flange on the inner side of the housing is situated in between. In a preferred embodiment, the retaining portion of the contact carrier is formed by an annular collar. The conductive element may be formed by a spring plate. The spring plate may be formed by a punched and bent element having one or more punched openings from which spring tongues project radially inwardly from the edges of the punched openings. These spring tongues may rest on the end face of the flange on the inner side of the housing. The spring tongues may be bent out from the plane of extent of the spring plate. The resilient preload with which the spring tongues lie against the end face of the flange may be exerted by the retaining collar of the contact carrier. The latter acts on the edge portion of the punched opening, thus pressing the pre-bent spring tongues against the edge portion of the contact carrier. Two or more such punched openings are preferably provided so that flanges situated adjacent to the contact carrier are connected to one another. The connection to the diverter is likewise preferably established via spring tongues which project from the edge of a further punched opening. The diverter may be a pin which is inserted into the housing. The pin may have an internal thread into which a connecting screw may be screwed in order to connect an aluminum outer housing to the plastics built-in housing which bears the sockets. The pin may be pressed from the inner side of the housing into a sleeve-shaped portion of the housing. This is preferably carried out using the heatsert process. The diverter also has a projection which is connected to a grounding printed conductor of a printed circuit board by soldering. The flange may also be pressed into a sleeve-shaped portion of the housing. The heatsert process is used here as well. Conical press-in surfaces are thus formed by the diverter or flange. In a variant of the invention, the diverter is formed by a wire, in particular a spring wire. This spring wire forms a helical leg spring. The helical portion of the spring is in contact, in particular clamping contact, with a cylindrical portion of the diverter under the action of resilient force. The two spring legs projecting from the helical portion may have bends. The ends of the spring legs are in resilient contact with a portion of the flange on the inner side of the housing. For this purpose the flange has a circumferential groove in which the spring legs engage.

BRIEF DESCRIPTION OF THE DRAWING

Exemplary embodiments of the invention are explained below with reference to the accompanying drawings, which show the following.

DETAILED DESCRIPTION OF THE INVENTION

Figure 1:
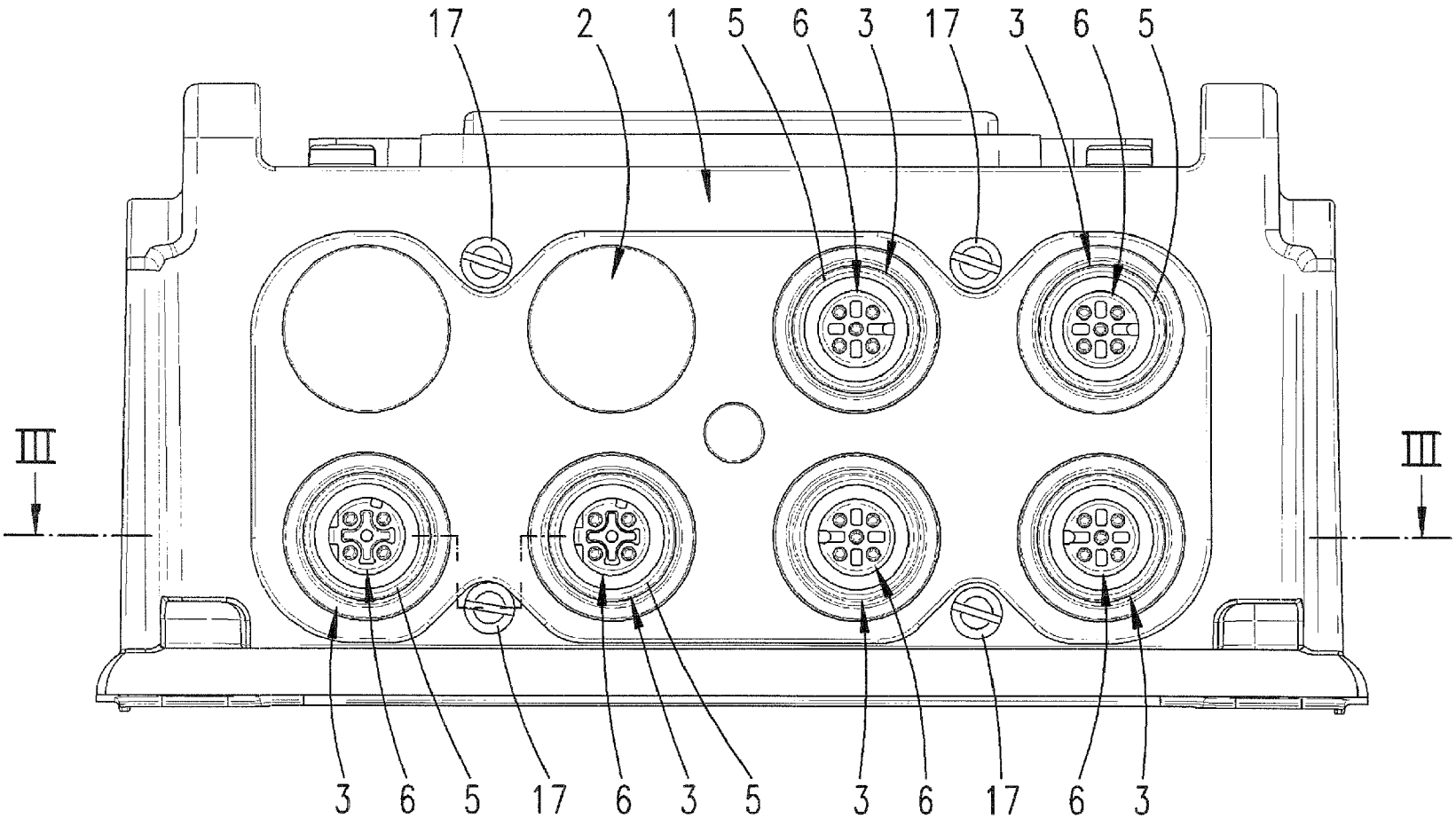
FIG. 1 shows a top view of an aluminum outer housing 1 having a plastics built-in housing 2 which has eight receptacles for sockets 3.
Figure 2:
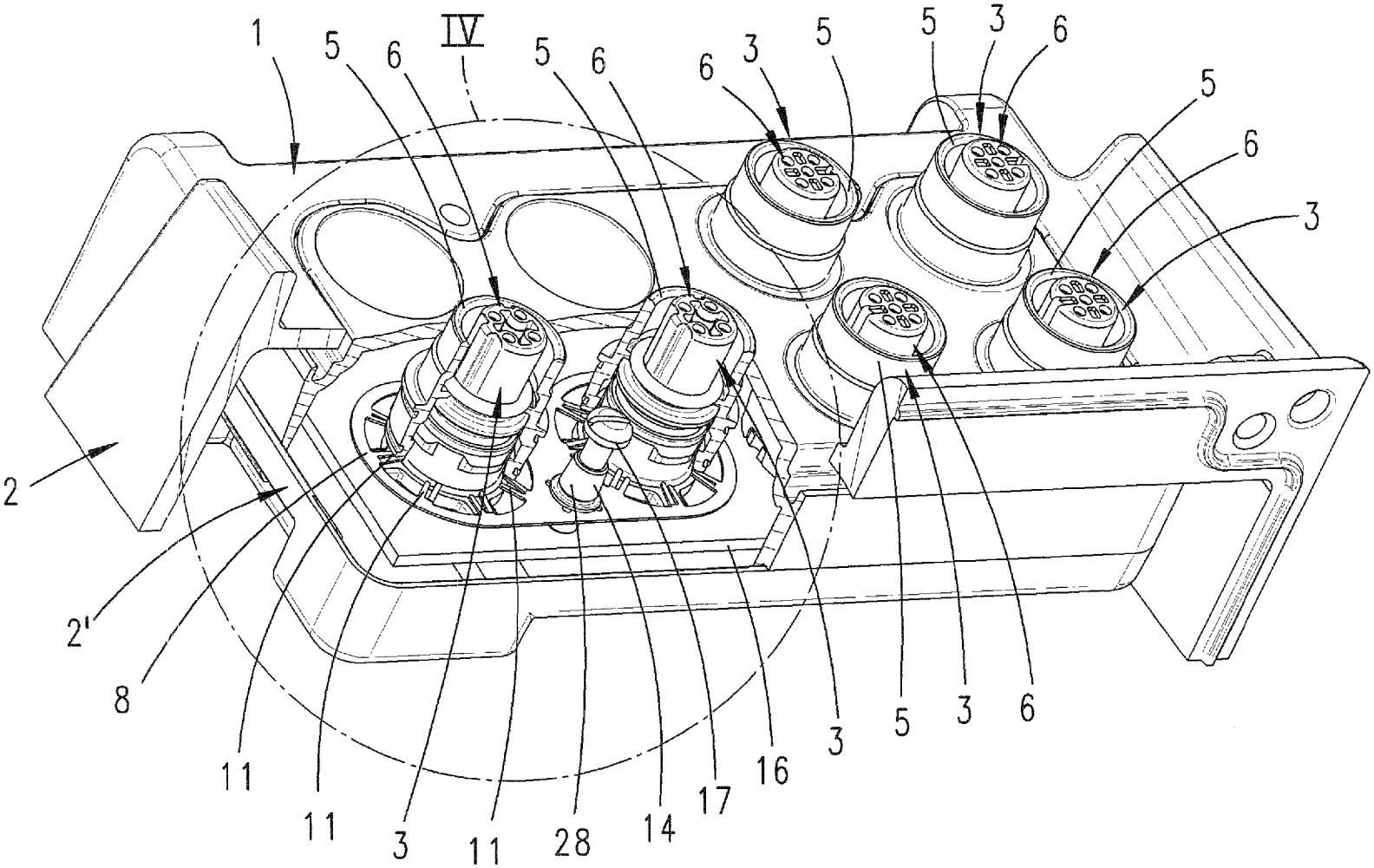
FIG. 2 shows a partially exposed, perspective illustration of the arrangement according to FIG. 1.
Figure 3:
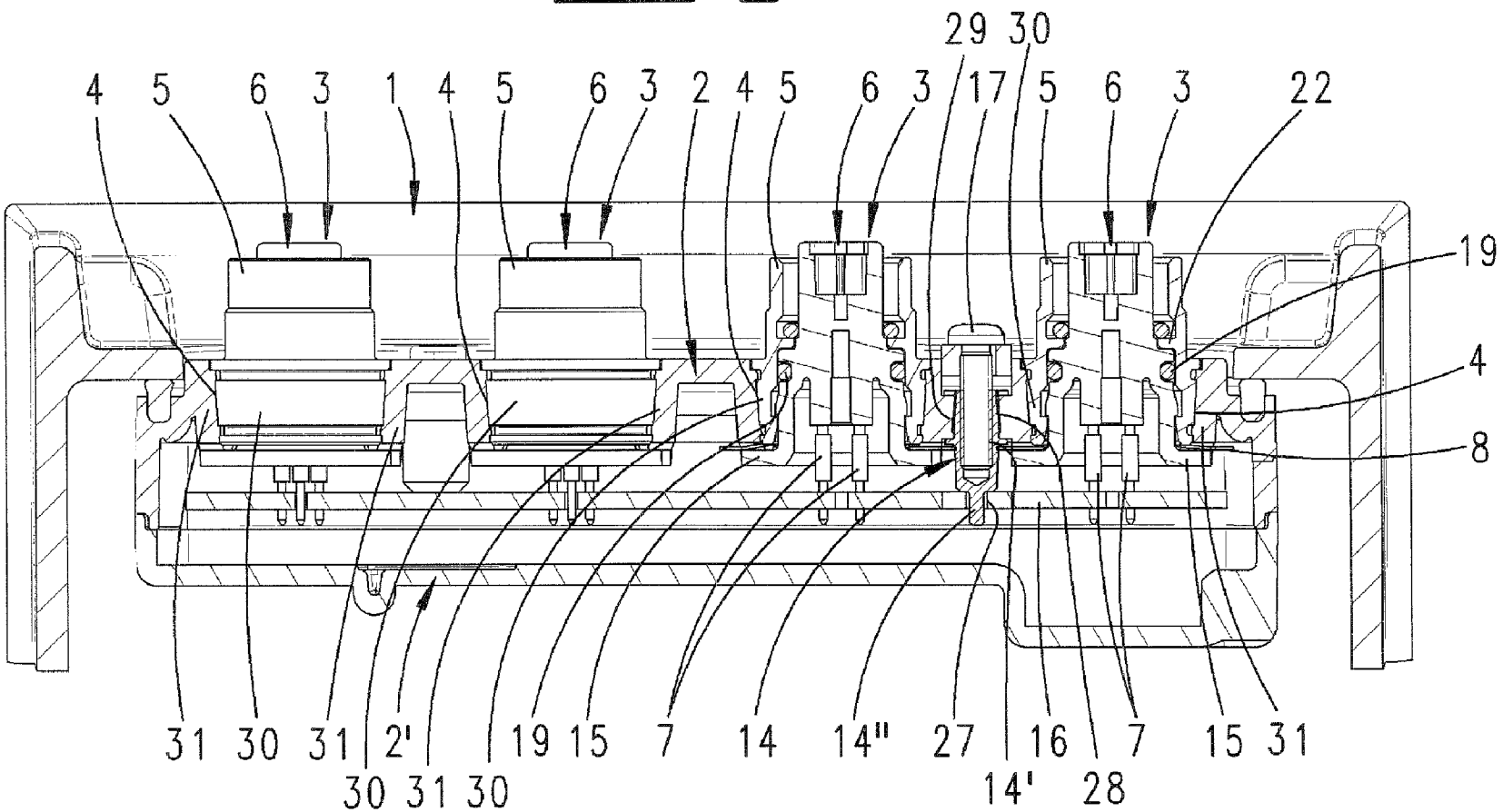
FIG. 3 shows a section according to line in FIG. 1.
Figure 4:
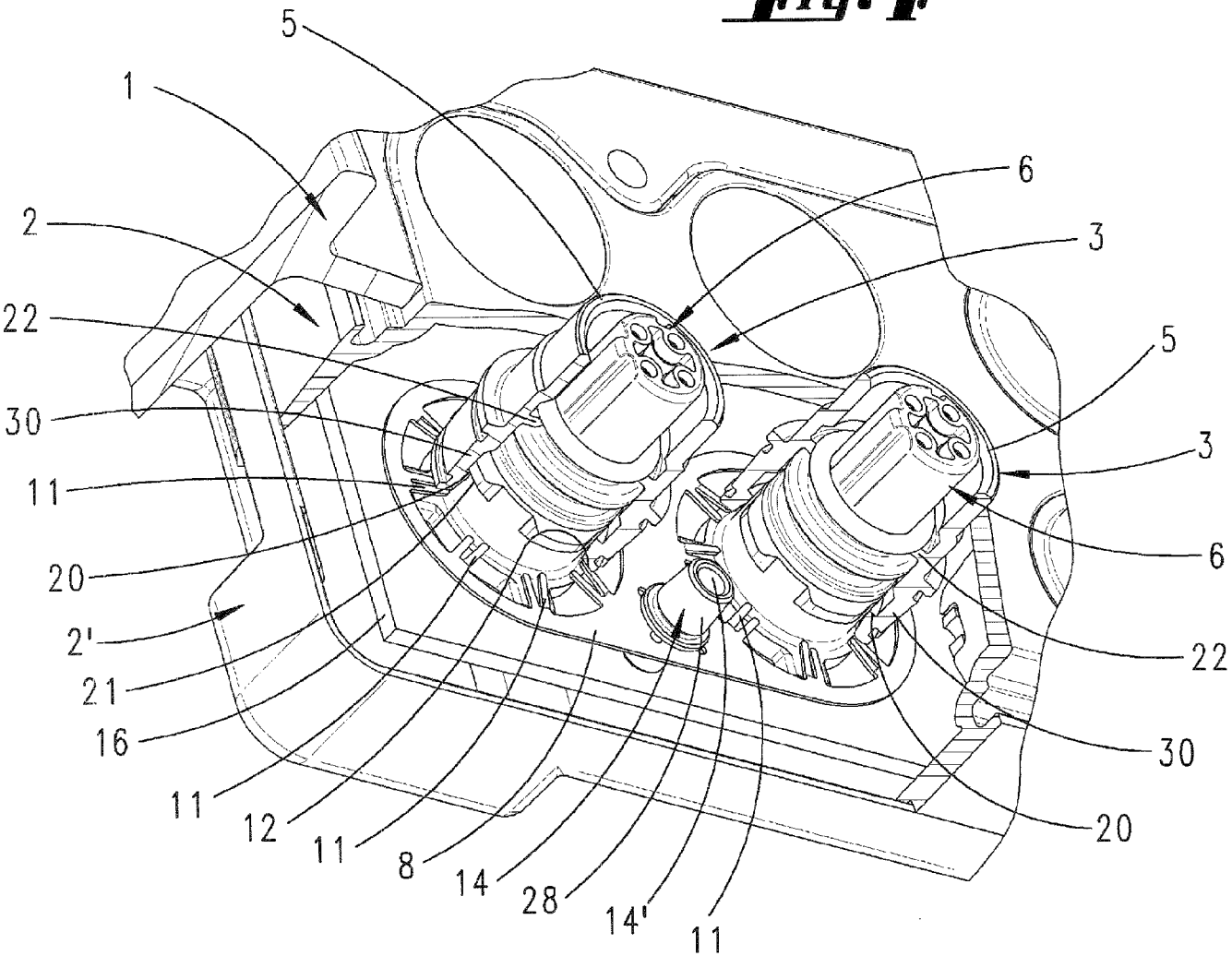
FIG. 4 shows enlarged region IV in FIG. 2.
Figure 5:
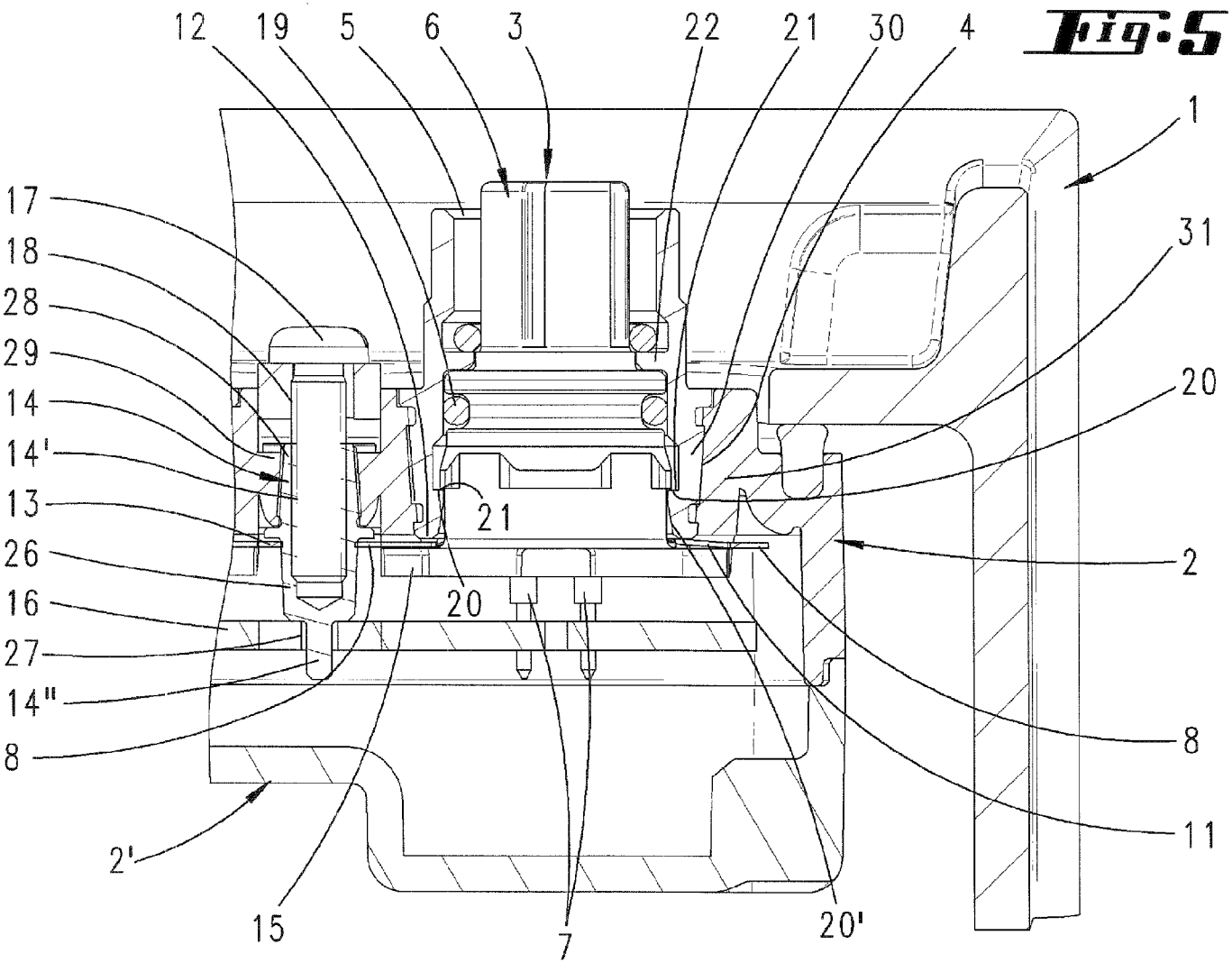
FIG. 5 shows enlarged region V in FIG. 3.
Figure 6:
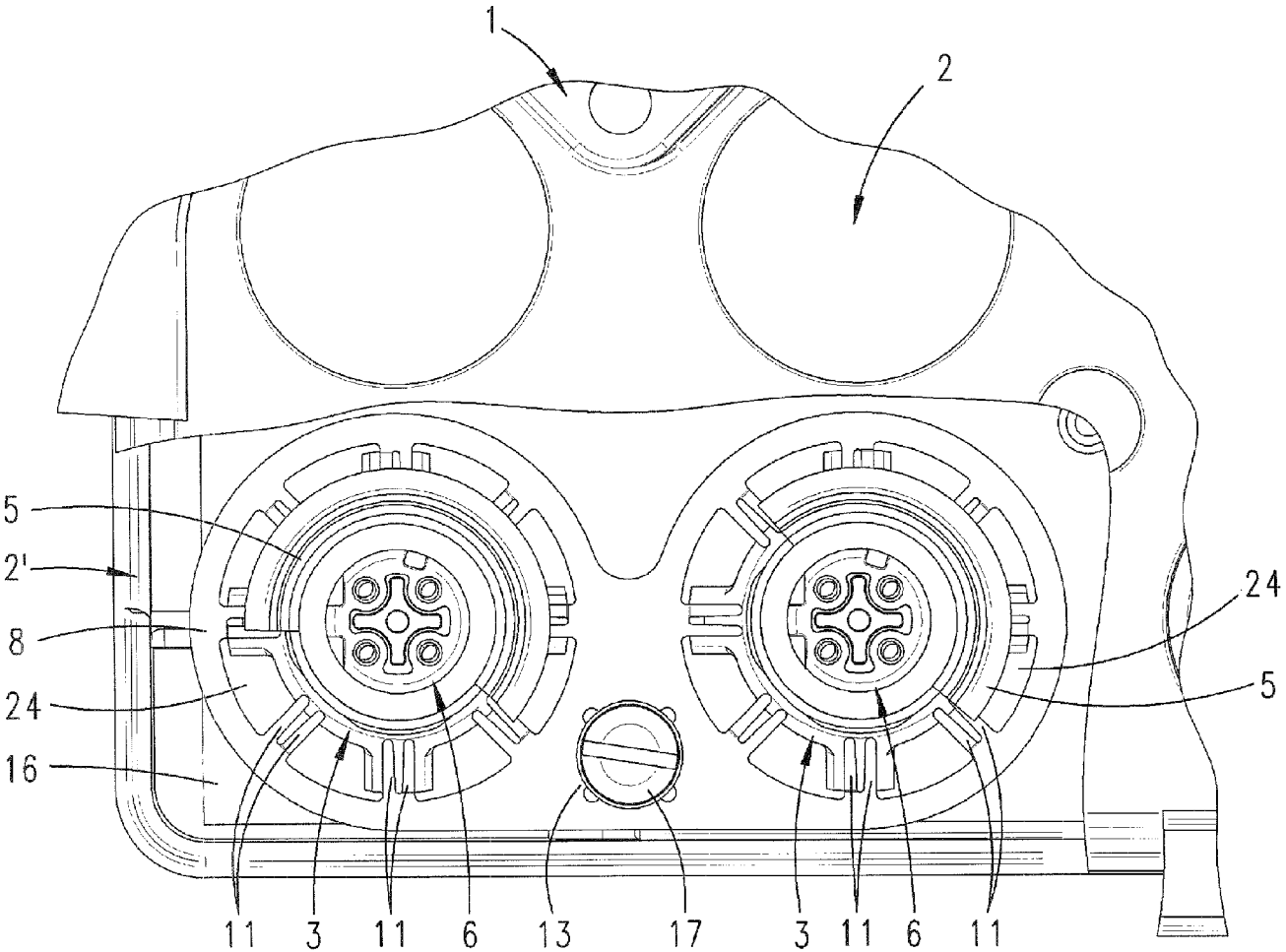
FIG. 6 shows a top view of the region illustrated in FIG. 4.
Figure 7:
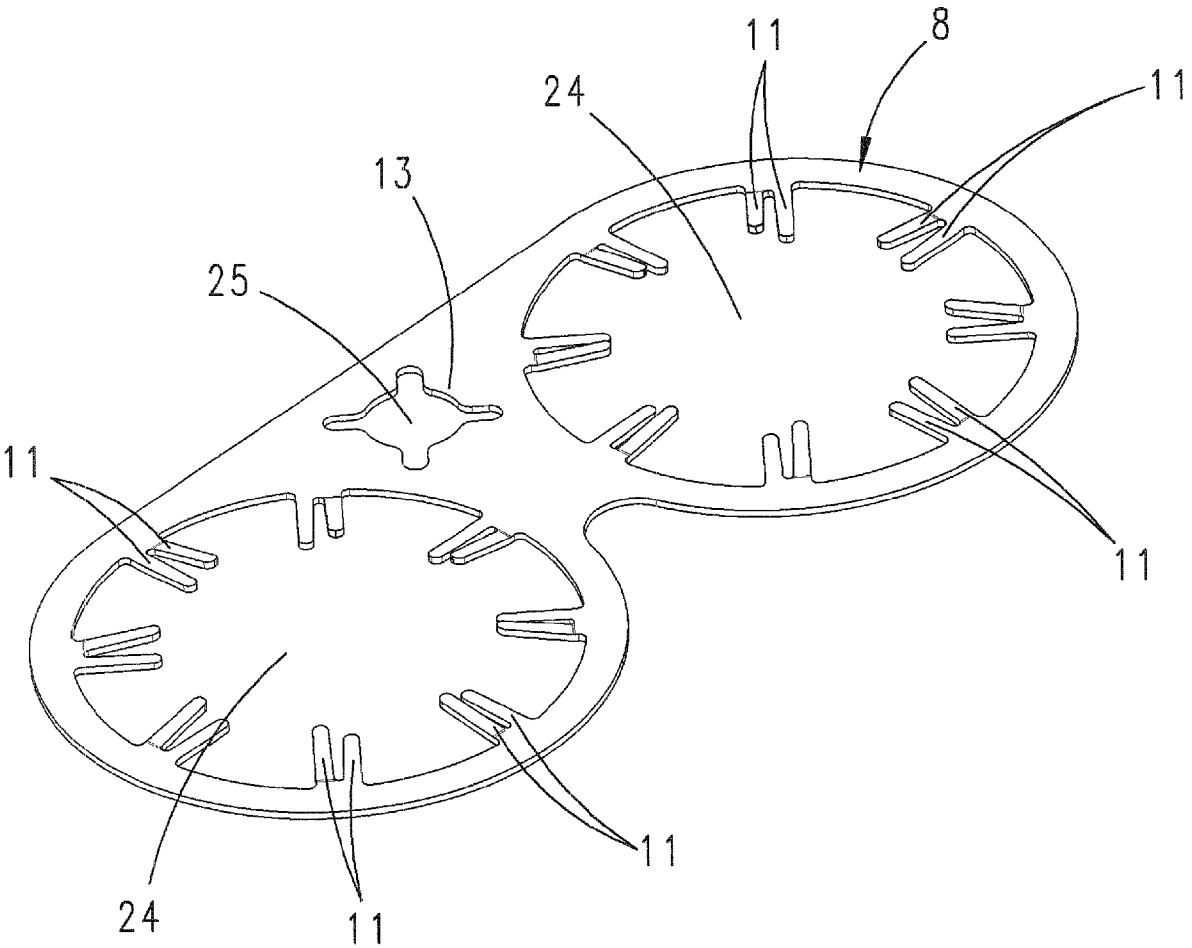
FIG. 7 shows the diverter 8, formed as a spring element.

A plastics built-in housing 2 composed of two shells is inserted into an aluminum housing 1 having a housing opening. The upper shell of the built-in housing 2 carries six sockets 3 on a total of eight available receptacles, the sockets projecting through the opening in the aluminum housing 1. A total of four securing tabs are provided at the edge of the opening in the aluminum housing 1; provided in the securing tabs are holes 18 through which screws 17, which are screwed into the inner thread 14' of a pin 14, pass.

The metal pin 14 has a conical portion 28 which is pressed into a sleeve-shaped portion 29 of the upper housing shell 2. The pin 14 is pressed into the sleeve-shaped portion 29 from the inner side of the housing, using heat. The end of the pin 14 opposite from the threaded opening of the inner thread 14' forms a contact portion 14" of smaller diameter which passes through a solder land 27 of a printed circuit board 16 situated in the housing 2. At that location the printed circuit board bears a grounding printed conductor to which the contact portion 14" is soldered in an electrically conductive manner.

The socket 3 has a sleeve-shaped flange 5. This flange has a conical press-in portion 30 which is pressed into a conical opening 4 in the housing. The housing opening 4 is associated with a sleeve portion 31. Here as well, the flange 5 is pressed in using heat, but from the outer side of the housing.

A contact carrier 6 is inserted into the opening in the cavity of the flange 5 facing the housing interior. This is a plastics part which bears the electrical contacts 7 that establish an electrically conductive connection with countercontacts of a plug when a corresponding mating plug has been inserted into the socket 3. The contacts 7 are connected to the printed circuit board 16.

A rear portion of the contact carrier 6 has an annularly circumferential step 21 which is situated ahead of a stop bevel. The flange 5 also has an annular detent shoulder 20 which is situated ahead of a stop bevel 20'. In the installed state the detent step 21 is supported on the detent shoulder 20. The contact carrier 6 is inserted into the opening in the flange 5 on the inner side of the housing. As a result, the two stop bevels slide over one another. The plastics contact carrier 6 may be resiliently deformed in the region of the detent step 21, and together with the detent shoulder 20 forms a clip connection.

A step of the contact carrier 6 is supported on a radially inwardly facing step 22 of the flange 5. A sealing ring 19 which lies in an annular channel of the contact carrier 6 is located between the step 22.

In the first exemplary embodiment illustrated in FIGS. 4 through 7, a conductive element 8 in the form of a spring plate is provided. The spring plate 8 is a punched and bent part having a total of three punched openings 24, 25. The two substantially circular punched openings 24 having a large diameter each provide a total of eight spring tongue pairs 11 which project radially inward from the edge. Each [element of a] spring tongue pair 11 is respectively bent away upwardly and downwardly from the plane of extent of the spring plate 8.

The opening 25 having the smaller diameter has four spring tongues 13. All of the spring tongues 11, 13 are uniformly distributed around the circumference.

Before the contact carriers 6 are clip-mounted, the spring plate 8 is inserted from the inside of the housing, with the spring tongues 11 resting on the end face 12 of the flange 5. The small punched opening 25 is placed over a conical contact portion 26 of the pin 14.

The contact carriers 6 of two adjacent sockets 3 are then inserted into the respective flanges 5 until the detent steps 21 engage with the steps 22. The rear end of the contact carrier 6 forms an annular collar 15. The collar 15 forms a retaining portion, which in the installed state rests on the edge of the punched opening 24. When the contact carrier 6 is associated with the flange 5, the spring tongues 11 are preloaded due to their outward bends. The spring tongues then lie against the end face 12 of the flange 5 on the inner side of the housing with resilient preload, and in each case form a planar conductive connection with the flange 5. The spring tongues 13 likewise form a planar conductive connection with the conical portion 26 of the pin 14. The head of the threaded screw 17 which is screwed into the threaded opening 14' forms an electrically conductive connection with the housing 1, and the contact portion 14" of the threaded screw forms an electrically conductive connection with the printed circuit board 16. As the result of this configuration, high-voltage discharges may be reliably diverted via the flange 5.

Figure 8:
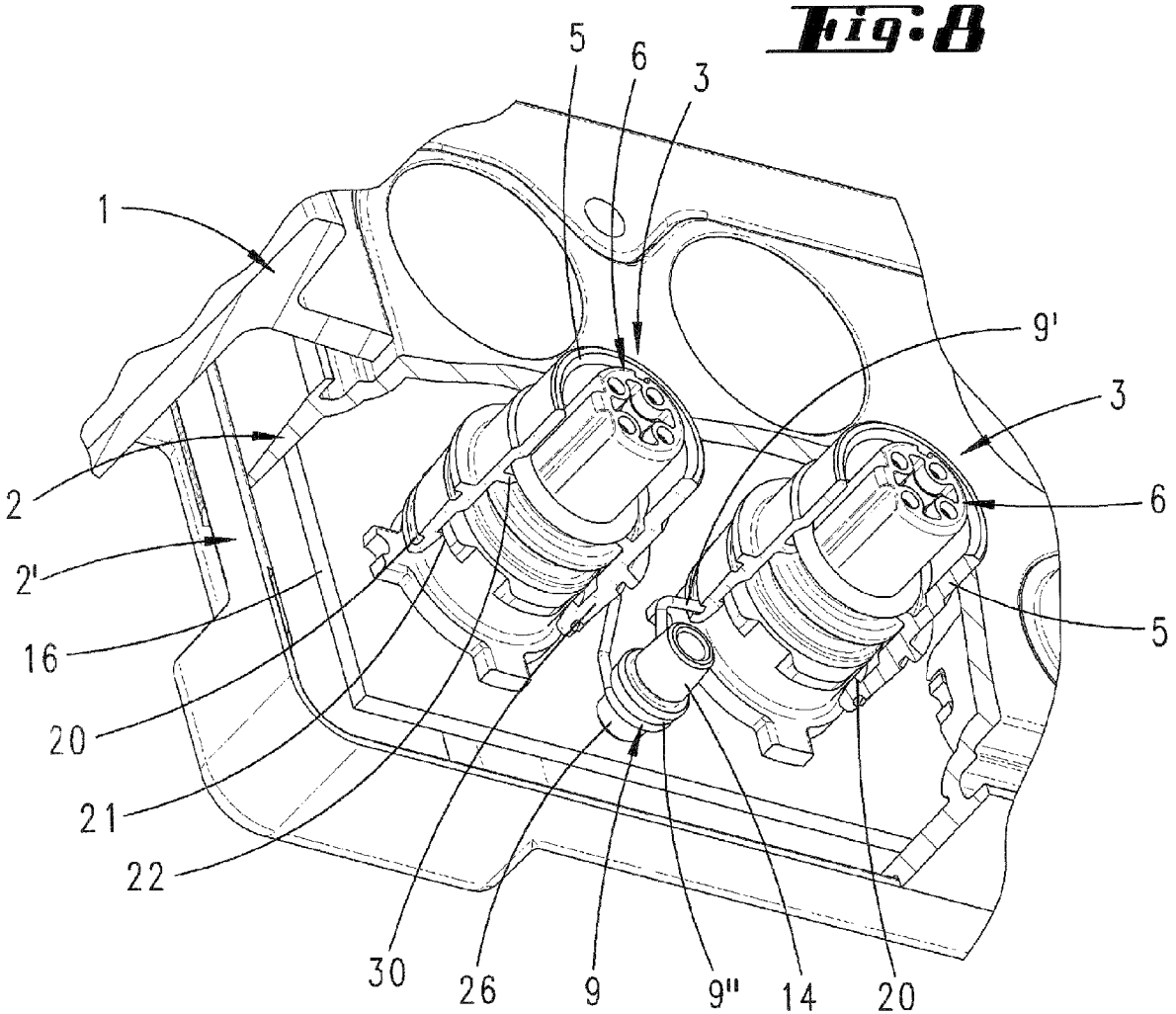
FIG. 8 shows an illustration, corresponding to FIG. 4, of a second exemplary embodiment in which the diverter is formed by a wire spring 9.
Figure 9:
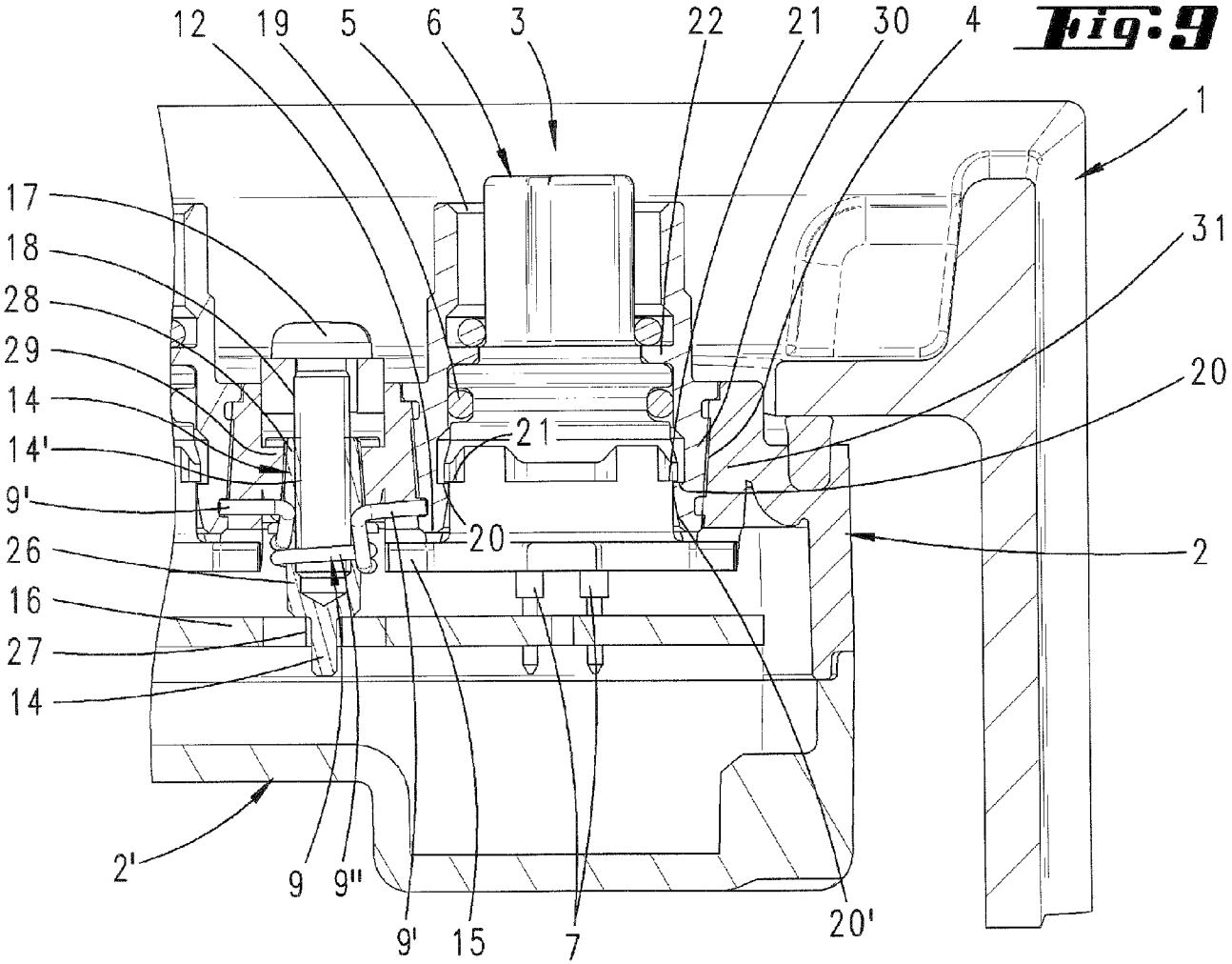
FIG. 9 shows an illustration, corresponding to FIG. 5, of the second exemplary embodiment.

In the second exemplary embodiment illustrated in FIGS. 8 and 9, the conductive element is formed by a wire spring 9. The wire spring is composed of a helical wire 9" and legs 9' which project therefrom.

The introduction portions of the spring plate 8 are formed by the spring tongues 11, whereas the introduction portions of the wire spring 9 are formed by legs 9'. The legs 9' may have bends which in each case lie with resilient contact in a circumferential groove 23 of the flange portion 12 on the inner side of the housing. The helical portion 9" of the spring 9 winds around and makes contact with a cylindrical or conical portion 26 of the pin 14, previously mentioned in the explanation of the first exemplary embodiment. Here as well, diversion of high voltage from the flange 5 to the pin 14 and the housing 1 or the printed circuit board 16, is ensured.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application.

The invention claimed is:

1. A socket arrangement, comprising: a housing bearing at least one socket having an electrically conductive flange inserted into a housing opening; a contact carrier inserted into the flange and having at least one electrically conductive contact for connecting to countercontacts of a plug corresponding to the socket; a conductive element situated in the housing and having an introduction portion which is connected in an electrically conductive manner to a portion of the flange inside the housing; and a diversion portion connected to a diverter, wherein the contact carrier is inserted into the flange from an inner side, and a retaining portion of the contact carrier at least partially overlaps an end face of the flange when the introduction portion of the conductive element lying against the end-face portion of the flange on the inner side of the housing is situated in between.

2. The socket arrangement according to claim 1, wherein the introduction portion lies against the end face portion of the flange with resilient preload.

3. The socket arrangement according to claim 1, wherein the conductive element is a spring plate having spring tongues or is a spring wire.

4. The socket arrangement according to claim 1, wherein the diverter is an electrically conductive pin that is inserted into the housing.

5. The socket arrangement according to claim 4, wherein the electrically conductive pin is a contact pin and/or a pin having an internal thread.

6. The socket arrangement according to claim 3, wherein a multiplicity of spring tongues of the conductive element acted on by the retaining portion lies against the end face of the flange on the inner side of the housing with resilient preload.

7. The socket arrangement according to claim 6, wherein the spring tongues project from an edge of a punched opening in substantially uniform distribution around the circumference, and lie against the flange with resilient loading.

8. The socket arrangement according to claim 1, wherein the retaining portion is an annular collar for the contact carrier which is clipped onto or screwed into the flange.

9. The socket arrangement according to claim 1, wherein the conductive element connects multiple flanges to one another in an electrically conductive manner.

10. The socket arrangement according to claim 1, wherein the diverter is connected to a grounding printed conductor of a printed circuit board at a contact projection.

11. The socket arrangement according to claim 1, wherein the conductive element forms a punched opening having inwardly directed spring tongues which lie against the diversion element with resilient loading.

12. The socket arrangement according to claim 1, wherein the diversion element and the flange are pressed into sleeve portions of a plastic housing.

13. A socket arrangement, comprising: a housing bearing at least one socket having an electrically conductive flange inserted into a housing opening; a contact carrier inserted into the flange and having at least one electrically conductive contact for connecting to countercontacts of a plug corresponding to the socket; a conductive element situated in the housing and having an introduction portion which is connected in an electrically conductive manner to a portion of the flange inside the housing; and a diversion portion which is connected to a diverter formed by a pin, wherein the conductive element is formed by a helical leg spring, the helical turn of the spring enclosing with frictional contact the diverter pin, and two legs of the spring, that have bends, lying with resilient contact in a circumferential groove in the portion of the flange on the inner side of the housing.

14. A socket arrangement, comprising: a housing bearing at least one socket having an electrically conductive flange inserted into a housing opening; and a contact carrier inserted into the flange and having at least one electrically conductive contact for connecting to countercontacts of a plug corresponding to the socket, wherein the contact carrier inserted into the flange from an inner side of the housing forms a detent step which in an inserted state is situated ahead of a detent shoulder of the flange.

15. The socket arrangement according to claim 14, further comprising a stop bevel which is situated ahead of the detent shoulder or the detent step.

* * * * *